US011506041B2

(12) United States Patent
Wang et al.

(10) Patent No.: US 11,506,041 B2
(45) Date of Patent: Nov. 22, 2022

(54) DRILLING-SLITTING-SEALING-FRACTURING DEVICE AND METHOD FOR A DEEP LOW-PERMEABILITY GASSY COAL SEAM

(71) Applicant: SHANDONG UNIVERSITY OF SCIENCE AND TECHNOLOGY, Qingdao (CN)

(72) Inventors: Gang Wang, Qingdao (CN); Zhiyuan Liu, Qingdao (CN); Weimin Cheng, Qingdao (CN); Xiangjie Qin, Qingdao (CN); Jiuyuan Fan, Qingdao (CN); Lulu Sun, Qingdao (CN); Zhen Liu, Qingdao (CN); Guanhua Ni, Qingdao (CN); Yanbin Yu, Qingdao (CN); Yixin Liu, Qingdao (CN); Qiming Huang, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 17/627,117

(22) PCT Filed: Jul. 23, 2020

(86) PCT No.: PCT/CN2020/103645
§ 371 (c)(1),
(2) Date: Jan. 13, 2022

(87) PCT Pub. No.: WO2021/159666
PCT Pub. Date: Aug. 19, 2021

(65) Prior Publication Data

US 2022/0213773 A1 Jul. 7, 2022

(30) Foreign Application Priority Data

Feb. 11, 2020 (CN) ..... 202010085632.8

(51) Int. Cl.
*E21B 43/26* (2006.01)
*E21B 43/114* (2006.01)
(Continued)

(52) U.S. Cl.
CPC ..... *E21B 43/261* (2013.01); *E21B 43/114* (2013.01); *E21B 43/26* (2013.01); *E21B 7/046* (2013.01); *E21B 15/04* (2013.01)

(58) Field of Classification Search
CPC ..... E21B 43/26; E21B 7/046; E21C 25/62; E21C 37/12
See application file for complete search history.

(56) References Cited

U.S. PATENT DOCUMENTS

2020/0080382 A1* 3/2020 Wang ..... E21B 10/32

FOREIGN PATENT DOCUMENTS

CN 104653161 A 5/2015
CN 108643877 A 10/2018
(Continued)

OTHER PUBLICATIONS

International Search Report and Written Opinion issued in International Application No. PCT/CN2020/103645; dated Sep. 30, 2020; 15 pgs.
(Continued)

*Primary Examiner* — Robert E Fuller
(74) *Attorney, Agent, or Firm* — Hauptman Ham, LLP

(57) ABSTRACT

A deep low-permeability gassy seam drilling-slitting-sealing-fracturing drilling device includes a drilling control system, a high-pressure water power system, a water pressure grading control system and a fracturing and sealing control system. The drilling control system adjusts a drilling direction a water supply pressure of the drill rod, the high-pressure water power system supplies high-pressure water with different pressures to the device, and the water
(Continued)

pressure grading control system ensures that a water pressure for flushing drill cuttings is less than 5 MPa, a water pressure for slitting in a direction perpendicular to a length of the drill rod is 25-35 MPa, a water pressure for sealing with a borehole sealing capsule is 35-40 MPa, and a water pressure for further pressure relief and permeability increasing of a coal seam is 40-50 MPa. The fracturing and sealing control system controls borehole sealing and hydrofracturing operations.

6 Claims, 2 Drawing Sheets

(51) Int. Cl.
*E21B 7/04* (2006.01)
*E21B 15/04* (2006.01)

(56) References Cited

FOREIGN PATENT DOCUMENTS

| | | |
|---|---|---|
| CN | 111088993 A | 5/2020 |
| WO | 2021/159666 A1 | 8/2021 |

OTHER PUBLICATIONS

Search Report issued in Chinese Application No. 2020100856328; dated Oct. 15, 2020; 5 pgs.
Office Action issued in Chinese Application No. 2020100856328; dated Oct. 22, 2020; 14 pgs.
Notice of Grant issued in Chinese Application No. 2020100856328; dated Nov. 12, 2020; 4 pgs.

* cited by examiner

DRILLING-SLITTING-SEALING-FRACTURING DEVICE AND METHOD FOR A DEEP LOW-PERMEABILITY GASSY COAL SEAM

RELATED APPLICATIONS

The present application is a U.S. National Phase of International Application Number PCT/CN2020/103645 filed Jul. 23, 2020 and claims priority to Chinese Application Number 2020100856328 filed Feb. 11, 2020.

TECHNICAL FIELD

The present invention relates to the technical field of gas drainage and coal seam dust precipitation in coal mines, and in particular to a deep low-permeability gassy seam drilling-slitting-sealing-fracturing drilling device and a method of realizing drilling, slitting, sealing and fracturing by using the device.

BACKGROUND

At present, coal mining is already shifted from shallow mining to deep mining. With an increasing mining depth, geostress or overburden of a coal seam also increases, resulting in extremely low permeability of the coal seam. Further, a gas pressure of the coal seam further increases, leading to a higher possibility of gas disasters. However, since gas is also a clean and efficient energy source, gas drainage may be effectively performed for the low-permeability coal seam to reduce the possibility of disasters and increase a utilization rate of gas. Therefore, it is an inevitable problem in the current scientific deep mining of coal mines. Statistically, most coal mines are gas shafts. To ensure normal and safe production of the shafts, gas drainage is usually performed for a gassy coal seam in advance, that is, a plurality of boreholes are constructed at different locations of the coal seam to perform hydraulic slitting for the gassy coal seam. Next, the boreholes are sealed by using a plurality of borehole packers. Then, hydrofracturing and permeability increasing are performed for a coal mass by injecting high-pressure water to allow gas to come out from the boreholes autonomously or drain the gas manually. However, the above process mainly has the following problems: (1) poor permeability increasing effect is achieved for the coal seam using a single borehole and the gas drainage efficiency is very low; (2) the working procedures of for a plurality of gas drainage boreholes for performing seam fracturing and permeability increasing manually are complex. Limited by the low permeability of the coal seam, the gas drainage efficiency is also very low. Further, the above process requires construction of a plurality of boreholes, leading to low construction efficiency and high production costs. Although some gas drainage methods, such as a high-location drilling gas drainage method and a gas drainage method based on seam hydrofracturing are also disclosed in the existing gas drainage study fields, these processes have following requirements: boreholes are firstly constructed, and then borehole sealing and coal seam hydrofracturing are performed after retreating the original drill rod and then gas drainage is performed, thus leading to process repeatability.

To realize the integrated process of "drilling-slitting-sealing-fracturing" and facilitate operations, it is required to provide a deep low-permeability gassy seam "drilling-slitting-sealing-fracturing" integrated drilling device and a method thereof so as to not only perform pre-fracturing and permeability increasing for the low-permeability coal seams, but also integrate the four processes "drilling-slitting-sealing-fracturing" without repeatedly driving or retreating the drill bit, thereby improving safety and operation efficiency of gas drainage.

SUMMARY

To realize single-device operation and integrated operation of drilling, in-hole slitting, borehole sealing and hydrofracturing, improve the working efficiencies of drilling of gas drainage and dust prevention of coal seam, and ensure the safety of gas drainage, the present invention provides a deep low-permeability gassy seam drilling-slitting-sealing-fracturing drilling device and a method thereof. The present invention adopts the following specific technical solution.

A deep low-permeability gassy seam drilling-slitting-sealing-fracturing drilling device includes a water tank, a high-pressure water pipe, a high-pressure pump, an overflow valve, a drill bit, a drill rod, a borehole sealing capsule (inflatable packer) and a control valve (sleeve valve), and further includes a drilling control system, a high-pressure water power system, a water pressure grading control system and a fracturing and sealing control system; the drilling control system adjusts a drilling direction and a water supply pressure of the drill rod, the high-pressure water power system supplies high-pressure water with a pressure of 0-50 MPa, and the water pressure grading control system adjusts a water pressure for flushing of drill cuttings to less than 5 MPa, adjusts a water pressure for slitting in a direction perpendicular to a length of the drill rod to 25-35 MPa, adjusts a water pressure for sealing with a borehole sealing capsule to 35-40 MPa, and adjusts a water pressure for pressure relief and permeability increasing in seam hydrofracturing to 40-50 MPa; the fracturing and sealing control system controls borehole sealing and hydrofracturing operations.

Preferably, the drilling control system includes a drilling angle controlling unit, a drilling speed controlling unit and a drilling angle correction controlling unit; the drilling angle controlling unit adjusts the drilling direction of the drill bit and the drill rod, the drilling speed controlling unit adjusts a rotation speed and a feeding force of a drilling machine, and the drilling angle correction controlling unit performs real-time correction for the drilling direction.

Preferably, a wet-type drill rod water outlet is disposed on the drill bit, and a slitting water outlet, a hydrofracturing water outlet and a borehole sealing capsule are disposed sequentially from the drill bit side along the length direction of the drill rod.

Preferably, the high-pressure water power system includes a water tank, a high-pressure pump, an overflow valve and a high-pressure water pipe; the high-pressure pump pumps water from the water tank and delivers high-pressure water via the high-pressure water pipe, and the overflow valve is disposed at the downstream of the high-pressure water pipe.

Preferably, the control valve of the water pressure grading control system includes a wet-type drill rod water pressure control valve, a slitting water pressure control valve, a capsule sealing water pressure control valve and a hydrofracturing control valve; the wet-type drill rod water pressure control valve is opened when the water pressure is less than 5 MPa, the slitting water pressure control valve is opened when the water pressure is 25-35 MPa, the capsule sealing water pressure control valve is opened when the water pressure is 35-40 MPa, and the hydrofracturing control valve is opened when the water pressure is 40-50 MPa.

Preferably, the fracturing and sealing control system includes a borehole sealing capsule and a hydrofracturing water outlet; after the borehole sealing capsule is filled with water to seal a borehole, the hydrofracturing water outlet discharges water to fracture a coal mass.

A deep low-permeability gassy seam drilling-slitting-sealing-fracturing drilling method using the above deep low-permeability gassy seam drilling-slitting-sealing-fracturing drilling device includes the following steps.

At step A, a coal seam requiring gas drainage is determined, and the deep low-permeability gassy seam drilling-slitting-sealing-fracturing drilling device is disposed in front of a working face.

At step B, working conditions of the drilling control system and the high-pressure water power system are checked, and opening and closing of the wet-type drill rod water pressure control valve, the slitting water pressure control valve, the capsule sealing water pressure control valve and the hydrofracturing control valve are checked.

At step C, drilling is performed with the drill bit and the drill rod along a drilling direction, the drilling control system corrects a drilling angle in real time, the wet-type drill rod water pressure control valve is opened during drilling, and the wet-type drill rod water outlet on the drill bit supplies water of less than 5 MPa to flush a borehole.

At step D, during slitting, the drill rod and the drill bit are left in the borehole, the wet-type drill rod water pressure control valve is closed, the slitting water pressure control valve is opened, and the slitting water outlet supplies high-pressure water with a water pressure of 25-35 MPa for slitting.

At step E, during hydrofracturing, the drill rod and the drill bit are left in the borehole, the wet-type drill rod water pressure control valve and the slitting water pressure control valve are closed, the capsule sealing water pressure control valve is opened, and the borehole sealing capsule is filled with high-pressure water of 35-40 MPa to complete sealing; after sealing, the hydrofracturing control valve is opened, and hydrofracturing water outlet discharges high-pressure water of 40-50 MPa to perform hydrofracturing for the coal mass.

Further preferably, the high-pressure water power system adjusts the water pressure and supplies the high-pressure water with a corresponding pressure during drilling, slitting and hydrofracturing operations.

Further preferably, a distance between the slitting water outlet and the drill bit is 1-2 m; a distance between the slitting water outlet and the borehole sealing capsule is adjusted by connecting the drill rod, and the distance of the slitting water outlet at the drill bit side from the borehole sealing capsule is 5-15 m; the hydrofracturing water outlet is disposed between the borehole sealing capsule and the slitting water outlet.

Further preferably, 1-3 slits are constructed within the same borehole by disposing 1-3 slitting water outlets and slitting water pressure control valves on the drill rod.

The present invention has the following beneficial effects. integration of the drilling, slitting, sealing and fracturing devices is realized in the deep low-permeability gassy seam, The drilling control system controls the drilling angle, the drilling speed and the drilling distance; the high-pressure water power system supplies high-pressure water with different pressures for operations, the water pressure grading control system controls the high-pressure water with different pressures for operations at different locations, the fracturing and sealing control system and the drill rod jointly perform borehole sealing, and different control systems cooperate with each other to perform pre-fracturing and permeability increasing for the low-permeability seam, thereby facilitating efficient gas drainage and further achieving wetting and dust reduction of the coal masses. In addition, the drill rod structure of the device is reasonably set without requiring repeatedly driving or retreating the drill bit, and the drilling-slitting-sealing-fracturing operation process is simplified, thereby ensuring efficient gas drainage and improving safety performance. The working method greatly simplifies the operation flow and the drilling operation is more flexible and convenient.

Numerals of the drawings are described as follows: 1—water tank; 2—high-pressure water pipe; 3—high-pressure pump; 4—drilling control system; 5—overflow valve; 6—drill rod and drill bit; 7—borehole sealing capsule; 8—borehole sealing capsule water inlet; 9—hydrofracturing water outlet; 10—slitting water outlet; 11—wet-type drill rod water outlet; 12—capsule sealing water pressure control valve; 13—hydrofracturing control valve; 14—slitting water pressure control valve; 15—wet-type drill rod water pressure control valve; 16—water guide hole; 17—control valve water outlet position; 18—control valve water blocking plate; 19—control valve water pressure sensing plate.

DETAILED DESCRIPTION OF THE EMBODIMENTS

As shown in FIGS. 1-4, specific examples of a deep low-permeability gassy seam drilling-slitting-sealing-fracturing drilling device and a method thereof according to the present invention will be described below.

Example 1

Figure 1:
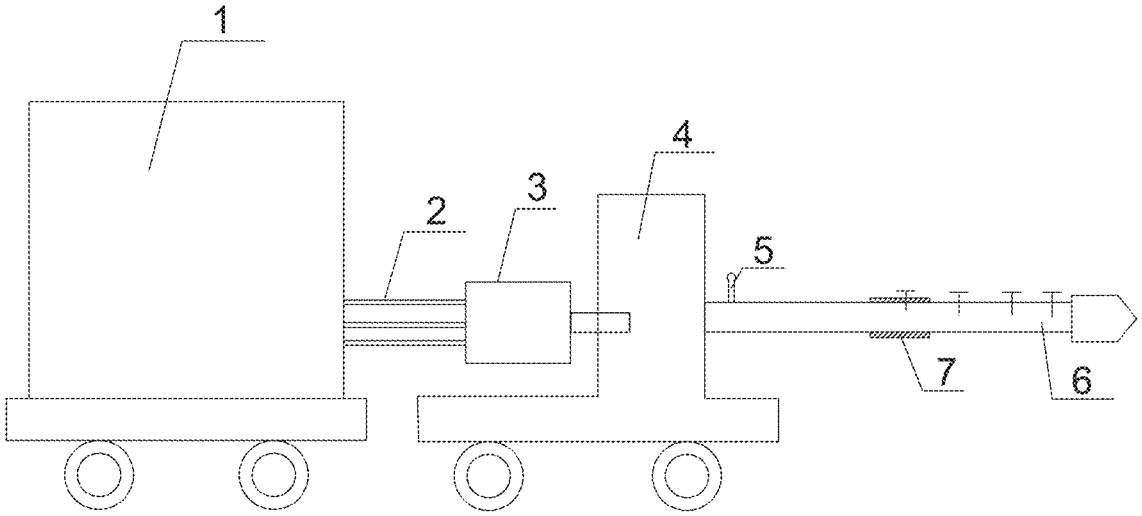
FIG. 1 is a structural schematic diagram of a deep low-permeability gassy seam drilling-slitting-sealing-fracturing drilling device.
Figure 2:
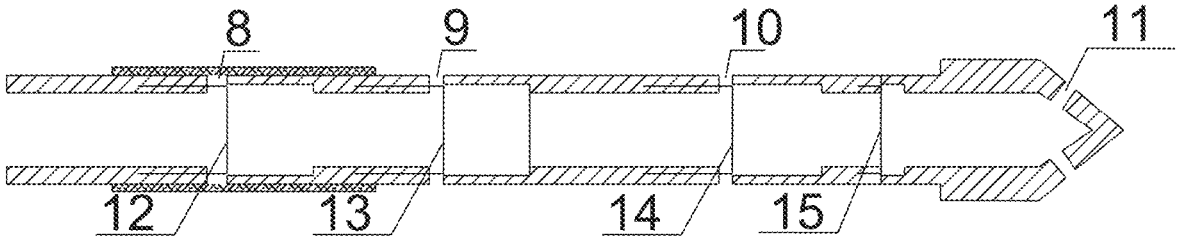
FIG. 2 is a structural schematic diagram of a drill bit and a drill rod.
Figure 3:
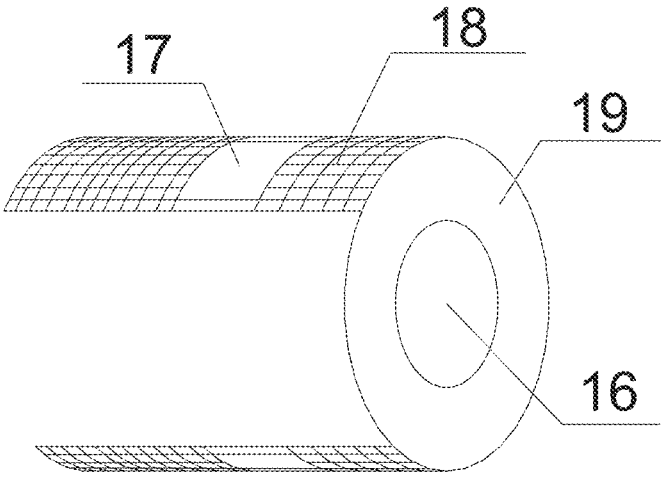
FIG. 3 is a structural schematic diagram of a control valve.

A deep low-permeability gassy seam drilling-slitting-sealing-fracturing drilling device includes a water tank, a high-pressure water pipe, a high-pressure pump, an overflow valve, a drill bit, a drill rod, a borehole sealing capsule and a control valve. The high-pressure pump is connected to the water tank via the high-pressure water pipe, and the high-pressure water pipe delivers water to a water pressure grading control system after the high-pressure pump is pressurized. The drill bit is disposed at an end of the drill rod, and the borehole sealing capsule is sleeved on the drill rod. The device further includes a drilling control system, a high-pressure water power system, a water pressure grading control system and a fracturing and sealing control system. The drilling control system is disposed at a front end of the device, the high-pressure water power system adjusts a water pressure, the water pressure grading control system controls drilling, slitting, sealing and fracturing operations respectively according to the water pressure, and the fracturing and sealing control system is disposed on the drill rod to fracture a coal mass after borehole sealing. A specific structure of the device is as shown in FIG. 1. The whole structure is a travel type structure (i. e. portable or mobile). The water tank is disposed behind the high-pressure water pipe, the high-pressure water pipe is connected to the drill rod, and the overflow valve is also connected on a water discharge pipe of the high-pressure pump. The specific structure of the drill bit and drill rod is as shown in FIG. 2. A structure of the control valve is as shown in FIG. 3.

The drilling control system adjusts a drilling direction and a water supply pressure of the drill rod, the high-pressure water power system supplies high-pressure water with a pressure of 0-50 MPa, and may adjust the water pressure according to the actual operation requirements. The water pressure grading control system adjusts a water pressure for flushing of drill cuttings to less than 5 MPa, adjusts a water pressure for slitting in a direction perpendicular to a length of the drill rod to 25-35 MPa, adjusts a water pressure for sealing with a borehole sealing capsule to 35-40 MPa, and adjusts a water pressure for pressure relief and permeability increasing in seam hydrofracturing to 40-50 MPa. The fracturing and sealing control system controls borehole sealing and hydrofracturing operations, that is, the fracturing and sealing control system controls the borehole sealing capsule to be filled with water to seal the borehole and the hydrofracturing water outlet to discharge water to fracture a coal mass respectively.

The drilling control system includes a drilling angle controlling unit, a drilling speed controlling unit and a drilling angle correction controlling unit. The drilling angle controlling unit adjusts the drilling direction of the drill bit and the drill rod, the drilling speed controlling unit adjusts a rotation speed and a feeding force of a drilling machine, and the drilling angle correction controlling unit performs real-time correction for the drilling direction. Specifically, the adjustments may be realized by using an adjustable drilling machine and an adjustable drilling machine support. In addition, a wet-type drill rod water outlet is also disposed on the drill bit, and a slitting water outlet, a hydrofracturing water outlet and a borehole sealing capsule are disposed sequentially from the drill bit side along the length direction of the drill rod. Several slittings may be performed by disposing one or more slitting water outlets. The whole drill rod may be formed through connection of a plurality of drill rods. FIG. 2 shows a drill rod which has a wet-type drill rod water pressure control valve, a slitting water pressure control valve, a capsule sealing water pressure control valve and a hydrofracturing control valve as well as water outlets. In practice, a distance between different outlets may be increased or adjusted by adjusting the number of the connected drill rods.

The high-pressure water power system supplies a water source for working procedures such as drill residue flushing, coal seam slitting, and borehole packer filling. The high-pressure water power system includes a water tank, a high-pressure pump, an overflow valve and a high-pressure water pipe. The high-pressure pump pumps water from the water tank and delivers high-pressure water via the high-pressure water pipe, where the water in the water tank is kept pure and free from impurities. The overflow valve is disposed at the downstream of the high-pressure water pipe to prevent damage to a pipeline or the control valve due to the excessively high water pressure.

The control valve of the water pressure grading control system includes a wet-type drill rod water pressure control valve, a slitting water pressure control valve, a capsule sealing water pressure control valve and a hydrofracturing control valve. The wet-type drill rod water pressure control valve is opened when the water pressure is less than 5 MPa, the slitting water pressure control valve is opened when the water pressure is 25-35 MPa, the capsule sealing water pressure control valve is opened when the water pressure is 35-40 MPa, and the hydrofracturing control valve is opened when the water pressure is 40-50 MPa. Therefore, grading control for different water pressures can be achieved, such that the specific working procedures are implemented by reasonably using the water pressures. As shown in FIG. 3, the structure of each control valve includes a water guide hole, a control valve water outlet portion, a control valve water blocking plate and a control valve water pressure sensing plate. The control valve water outlet is disposed on the control valve water blocking plate, the control valve water pressure sensing plate is disposed at an end of the control valve water blocking plate, and the water guide hole is also disposed in a middle portion of the control valve water pressure sensing plate.

The fracturing and sealing control system includes a borehole sealing capsule and a hydrofracturing water outlet. The borehole sealing capsule is formed by a wear-resistant and high-pressure-resistant capsule embedded on the drill rod. After the borehole sealing capsule is filled with water to seal the borehole, the hydrofracturing water outlet discharges water to fracture the coal mass so as to further expand cracks, thereby facilitating efficient gas drainage and further achieving wetting and dust reduction of the coal mass.

A deep low-permeability gassy seam drilling-slitting-sealing-fracturing drilling method that uses the above deep low-permeability gassy seam drilling-slitting-sealing-fracturing drilling device and is applied to a deep low-permeability gassy seam is provided. The method includes the following operation steps.

At step A, a coal seam requiring gas drainage is determined, and the deep low-permeability gassy seam drilling-slitting-sealing-fracturing drilling device is disposed in front of a working face.

At step B, working conditions of the drilling control system and the high-pressure water power system are checked, and opening and closing of the wet-type drill rod water pressure control valve, the slitting water pressure control valve, the capsule sealing water pressure control valve and the hydrofracturing control valve are checked. In this way, water flowing out of the drill rod can be observed through passage of water.

At step C, drilling is performed with the drill bit and the drill rod along a drilling direction, the drilling control system corrects a drilling angle in real time, the wet-type drill rod water pressure control valve is opened during drilling, and the wet-type drill rod water outlet on the drill bit supplies water of less than 5 MPa to flush the borehole.

At step D, during slitting, the drill rod and the drill bit are left in the borehole, the wet-type drill rod water pressure control valve is closed, the slitting water pressure control valve is opened, and the slitting water outlet supplies high-pressure water with a water pressure of 25-35 MPa for slitting.

At step E, during hydrofracturing, the drill rod and the drill bit are left in the borehole, the wet-type drill rod water pressure control valve and the slitting water pressure control valve are closed, the capsule sealing water pressure control valve is opened, and the borehole sealing capsule is filled with high-pressure water of 35-40 MPa to complete sealing; after borehole sealing, the hydrofracturing control valve is opened, and the hydrofracturing water outlet discharges high-pressure water of 40-50 MPa to perform hydrofracturing for the coal mass.

During drilling, slitting and hydrofracturing operations, the high-pressure water power system adjusts the water pressure and supplies the high-pressure water with a corresponding pressure. A distance between the slitting water outlet and the drill bit is 1-2 m; a distance between the slitting water outlet and the borehole sealing capsule is adjusted by connecting the drill rod, and the distance of the slitting water outlet at the drill bit side from the borehole sealing capsule is 5-15 m; the hydrofracturing water outlet is disposed between the borehole sealing capsule and the slitting water outlet. 1-3 slits may be constructed within the same borehole by disposing 1-3 slitting water outlets and slitting water pressure control valves on the drill rod.

The drill rod structure of the deep low-permeability gassy seam drilling-slitting-sealing-fracturing drilling device is reasonably designed without requiring repeatedly driving and retreating the drill bit, and the operation processes of drilling, slitting, sealing and hydrofracturing are simplified, thereby ensuring efficient gas drainage and improving safety performance. The operation method greatly simplifies the operation flow, and the drilling operation is more flexible and convenient.

Example 2

Based on the example 1, the example illustrates the beneficial effects of the device and method through actual applications.

According to the working processes of the borehole water injection and permeability increasing site and the actual multi-shaft coal seam water injection situations of the gassy seams of a northern district of a coal mine of Shandong province, China, which is at the east wing of the 43 # coal seam and has a horizontal elevation of 500 m, the water pressure grading control system is preferably selected to adjust the water pressure for flushing drill cuttings to less than 5 MPa, adjust the water pressure for slitting along a direction perpendicular to the length of the drill rod to 25-35 MPa, adjust the water pressure for sealing with the borehole sealing capsule to 35-40 MPa, and adjust the water pressure for pressure relief and permeability increasing of seam hydrofracturing to 40-50 MPa. These parameters are applied to an actual shaft operation to verify reasonableness and effectiveness of the selected parameters.

There is provided a deep low-permeability gassy seam drilling-slitting-sealing-fracturing drilling method that is applied to a northern district of a coal mine of Shandong province, China, which is at the east wing of the 43 # coal seam and has a horizontal elevation of 500 m, by using the deep low-permeability gassy seam drilling-slitting-sealing-fracturing drilling device. The method specifically includes the following operation steps.

At step A, a coal seam requiring gas drainage is determined, that is, the gassy seam of a northern district of a coal mine of Shandong province, China, which is at the east wing of the 43 # coal seam and has a horizontal elevation of 500 m, is determined as the gassy seam, and the deep low-permeability gassy seam drilling-slitting-sealing-fracturing drilling device is disposed in front of a working face.

At step B, working conditions of the drilling control system and the high-pressure water power system are checked, and specifically, whether the drilling angle controlling unit, the drilling speed controlling unit and the drilling angle correction controlling unit are operated normally is checked. Opening and closing of the wet-type drill rod water pressure control valve, the slitting water pressure control valve, the capsule sealing water pressure control valve and the hydrofracturing control valve are checked such that the working conditions of different outlets and valves can be observed through passage of water. The high-pressure water power system adjusts the water pressure and supplies the high-pressure water with a corresponding pressure during drilling, slitting and hydrofracturing operations.

At step C, drilling is performed with the drill bit and the drill rod along a drilling direction, the drilling control system corrects a drilling angle in real time, the wet-type drill rod water pressure control valve is opened during drilling, and the wet-type drill rod water outlet on the drill bit supplies water of less than 5 MPa to flush the borehole so as to discharge drill cuttings generated by drilling.

At step D, during slitting, the drill rod and the drill bit are left in the borehole, the wet-type drill rod water pressure control valve is closed, the slitting water pressure control valve is opened, and the slitting water outlet supplies high-pressure water with a water pressure of 25-35 MPa for slitting; one drill rod with a slitting water pressure control valve and a slitting water outlet is connected every other 5 m so as to construct a plurality of slits within the same borehole; the depth of the slit is adjusted according to actual operation requirements.

At step E, a location where hydrofracturing is performed is determined, the drill rod and the drill bit are left in the borehole, the wet-type drill rod water pressure control valve and the slitting water pressure control valve are closed, the capsule borehole sealing water pressure control valve is opened, and the borehole sealing capsule is filled with high-pressure water of 35-40 MPa to complete sealing; after borehole sealing, the hydrofracturing control valve is opened to perform hydrofracturing for the coal mass with high-pressure water of 40-50 MPa from the hydrofracturing water outlet. Further, it is checked whether the borehole is tightly sealed before hydrofracturing.

A distance between the slitting water outlet and the drill bit is 1-2 m. After the drill bit and the drill rod are drilled into the borehole, a drilling depth of the drill rod is determined to perform slitting at an appropriate position. A distance between the slitting water outlet and the borehole sealing capsule is adjusted by connecting the drill rod, and the distance of the slitting water outlet at the drill bit side from the borehole sealing capsule is 5-15 m. When one slit is needed, the distance may be 5 m; when two slits are needed, the distance may be 10 m; when three slits are needed, the distance may be 15 m. The hydrofracturing water outlet is disposed between the borehole sealing capsule and the slitting water outlet. When hydrofracturing is required, after the drill bit and the drill rod are drilled in, the borehole is firstly sealed with the borehole sealing capsule, and then the water pressure is adjusted to perform hydrofracturing. 1-3 slits may be constructed within the same borehole by disposing 1-3 slitting water outlets and slitting water pressure control valves on the drill rod. In addition, when the water pressure exceeds 50 MPa, the overflow valve mounted outside will be automatically opened to relieve the pressure, and the entire working procedure is stopped.

Figure 4:
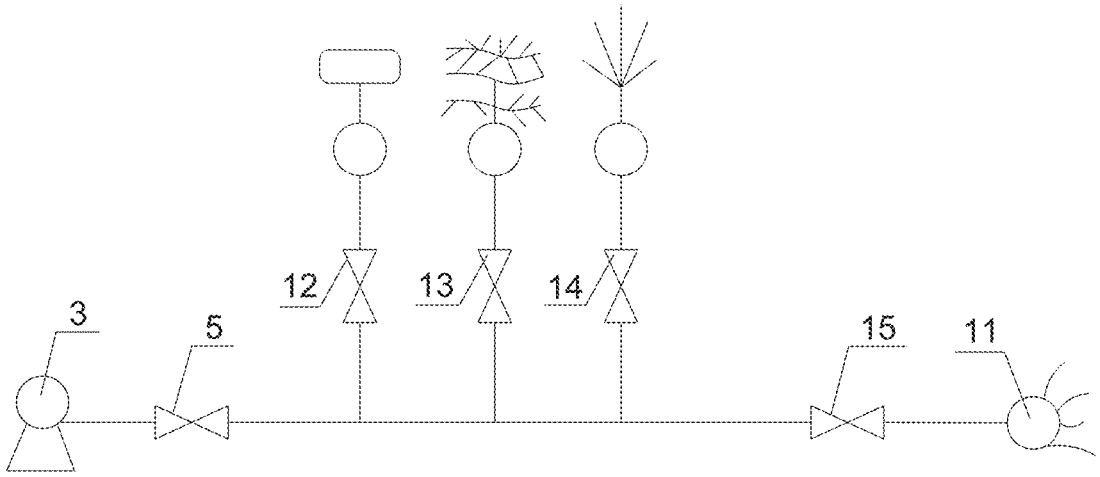
FIG. 4 is a simple schematic diagram of a water pressure grading control system.

Different control valves are connected as shown in FIG. 4. The high-pressure pump is connected to the overflow valve, and the high-pressure water is delivered into the drill rod via the high-pressure water pipe. A borehole sealing capsule branch, a hydrofracturing branch and a slitting branch are sequentially disposed on the drill rod. In this way, water goes directly to the drill bit through the drill rod and comes out of the drill bit to perform wet drilling. The capsule sealing water pressure control valve, the hydrofracturing control valve and the slitting water pressure control valve are disposed on each branch respectively. In addition, the disposal of each valve may be omitted to complete the operations of single drilling, slitting, sealing and fracturing. To prevent mutual interference of different water pressures in the four working procedures "drilling-slitting-sealing-fracturing", that is, to ensure normal operation of different hydraulic pressure control valves in step D, Table 1 lists the working pressure intervals of different control valves in detail.

TABLE 1

| No. | Name | Pressure threshold/MPa | Working status |
|---|---|---|---|
| 1 | wet-type drill rod water pressure control valve | 0 < P < 5 | Opened |
| | | P > 5 | Opened |
| 2 | slitting water pressure control valve | 0 < P < 25 | Closed |
| | | 25 < P < 35 | Opened |
| | | P > 35 | Closed |
| 3 | capsule sealing water pressure control valve | 0 < P < 35 | Closed |
| | | 35 < P < 40 | Opened |
| | | P > 40 | Closed |
| 4 | hydrofracturing control valve | 0 < P < 40 | Closed |
| | | 40 < P < 50 | Opened |
| | | P > 50 | Closed |
| 5 | Overflow valve | 0 < P < 50 | Closed |
| | | P > 50 | Opened |

Certainly, the foregoing descriptions are not intended to limit the present disclosure, and the present invention is not limited to the above examples. Changes, modifications, additions or substitutions made by persons skilled in the art within the scope of essence of the present invention shall also be encompassed in the scope of protection of the present disclosure.

The invention claimed is:

1. A deep low-permeability gassy seam drilling-slitting-sealing-fracturing drilling method for a deep low-permeability gassy coal seam using a drilling-slitting-sealing-fracturing device, wherein the device comprises a water tank, a high-pressure water pipe, a high-pressure pump, an overflow valve, a drill bit, and a drill rod, and further comprising a drilling control system, a high-pressure water power system, a water pressure grading control system and a fracturing and sealing control system, wherein, the fracturing and sealing control system comprises a borehole sealing capsule and a hydrofracturing water outlet, and after the borehole sealing capsule is filled with water to seal a borehole, the hydrofracturing water outlet discharges water to fracture a coal mass;

the drilling control system adjusts a drilling direction, the high-pressure water power system supplies high-pressure water with a pressure being 0-50 MPa, a water pressure for flushing of drill cuttings being less than 5 MPa, a water pressure for slitting in a direction perpendicular to a length of the drill rod being 25-35 MPa, a water pressure for borehole sealing with the borehole sealing capsule being 35-40 MPa, a water pressure for pressure relief and permeability increasing in seam hydro-fracturing being 40-50 MPa; the fracturing and sealing control system controls borehole sealing and hydrofracturing operations;

a drill rod water outlet is disposed on the drill bit, and a slitting water outlet, a hydrofracturing water outlet and the borehole sealing capsule are disposed sequentially from a side of the drill bit along the length direction of the drill rod; and the water pressure grading control system comprises a drill rod water pressure control valve, a slitting water pressure control valve, a capsule sealing water pressure control valve and a hydrofracturing control valve;

the method comprising the following steps:

at step A, determining a coal seam requiring gas drainage, and disposing the device in front of a working face;

at step B, checking working conditions of the drilling control system and the high-pressure water power system, and checking opening and closing of the drill rod water pressure control valve, the slitting water pressure control valve, the capsule sealing water pressure control valve and the hydrofracturing control valve;

at step C, performing drilling with the drill bit and the drill rod along a drilling direction thereby creating a borehole in the working face, correcting a drilling angle by the drilling control system in real time, opening the drill rod water pressure control valve during drilling, and supplying water of less than 5 MPa for flushing the borehole from a drill rod water outlet on the drill bit;

at step D, during slitting, leaving the drill rod and the drill bit in the borehole, closing the drill rod water pressure control valve, opening the slitting water pressure control valve, and supplying high-pressure water with a water pressure of 25-35 MPa for slitting from a slitting water outlet; and at step E, during hydrofracturing, leaving the drill rod and the drill bit in the borehole, maintaining the drill rod water pressure control valve closed and closing the slitting water pressure control valve, opening the capsule sealing water pressure control valve, and filling the borehole sealing capsule with high-pressure water of 35-40 MPa to complete sealing; after sealing, opening the hydrofracturing control valve, and discharging high-pressure water of 40-50 MPa from the hydrofracturing water outlet to perform hydrofracturing for the coal mass.

2. The deep low-permeability gassy seam drilling-slitting-sealing-fracturing drilling method according to claim 1, wherein the drilling control system comprises a drilling angle controlling unit, a drilling speed controlling unit and a drilling angle correction controlling unit; the drilling angle controlling unit adjusts the drilling direction of the drill bit and the drill rod, the drilling speed controlling unit adjusts a rotation speed and a feeding force of a drilling machine, and the drilling angle correction controlling unit performs real-time correction for the drilling direction.

3. The deep low-permeability gassy seam drilling-slitting-sealing-fracturing drilling method according to claim 1, wherein the high-pressure water power system comprises a water tank, a high-pressure pump, an overflow valve and a high-pressure water pipe; the high-pressure pump pumps water from the water tank and delivers high-pressure water via the high-pressure water pipe, and the overflow valve is disposed at the downstream upstream of the high-pressure water pipe.

4. The deep low-permeability gassy seam drilling-slitting-sealing-fracturing drilling method according to claim 1, wherein the high-pressure water power system supplies the high-pressure water during drilling, slitting and hydrofracturing operations.

5. The deep low-permeability gassy seam drilling-slitting-sealing-fracturing drilling method according to claim 1, wherein a distance between the slitting water outlet and the drill bit is 1-2 m; a distance between the slitting water outlet and the borehole sealing capsule is adjusted by connecting the drill rod, and the distance of the slitting water outlet and the borehole sealing capsule is 5-15 m; the hydrofracturing water outlet is disposed between the borehole sealing capsule and the slitting water outlet.

6. The deep low-permeability gassy seam drilling-slitting-sealing-fracturing drilling method according to claim 1, wherein 1-3 slits are completed within the borehole by disposing 1-3 slitting water outlets and slitting water pressure control valves on the drill rod.

* * * * *